US008616630B1

(12) United States Patent
Midkiff et al.

(10) Patent No.: US 8,616,630 B1
(45) Date of Patent: Dec. 31, 2013

(54) TAILGATING PICNIC BENCH AND TABLE COMBINATION

(76) Inventors: Thomas Midkiff, Destin, FL (US); John R. Tolbert, Sr., Lynn Haven, FL (US); John R. Tolbert, Lynn Haven, FL (US)

( * ) Notice: Subject to any disclaimer, the term of this patent is extended or adjusted under 35 U.S.C. 154(b) by 300 days.

(21) Appl. No.: 12/614,723

(22) Filed: Nov. 9, 2009

(51) Int. Cl.
*A47B 83/02* (2006.01)

(52) U.S. Cl.
USPC ..... 297/174 R; 297/135; 297/170; 108/44

(58) Field of Classification Search
USPC ..... 297/135, 170, 174 R, 440.24; 108/44
See application file for complete search history.

(56) References Cited

U.S. PATENT DOCUMENTS 5,833,308 A 11/1998 Strong, III et al.
5,857,741 A 1/1999 Anderson
5,950,617 A * 9/1999 Lorenz ..... 126/276
6,125,480 A 10/2000 Soffar et al.
6,250,702 B1 * 6/2001 Eipper ..... 296/26.1
6,269,578 B1 8/2001 Callegari
6,314,891 B1 11/2001 Larson
6,739,269 B1 * 5/2004 Benton ..... 108/44
6,739,643 B1 5/2004 Rock et al.
6,752,088 B2 * 6/2004 Poarch et al. ..... 108/44
6,808,231 B1 10/2004 Hill
6,908,150 B1 * 6/2005 Wegner et al. ..... 297/217.1
6,935,064 B1 * 8/2005 Thompson ..... 42/94
6,945,177 B2 * 9/2005 Chambers ..... 108/44
7,073,857 B1 7/2006 Bailey
7,152,358 B1 * 12/2006 LeAnna et al. ..... 42/94
D593,760 S * 6/2009 Fidler ..... D6/338

* cited by examiner

*Primary Examiner* — Philip Gabler
(74) *Attorney, Agent, or Firm* — Garvey, Smith, Nehrbass & North, L.L.C.; Gregory C. Smith; Julia M. FitzPatrick

(57) ABSTRACT

A tailgating bench and table combination, including a bench portion, having a bench frame supporting a bench cushion, and further comprising a member insertable into a trailer hitch of a vehicle; a pair of leg members on the bench frame, supporting the bench portion; a flat table portion, having a pair of legs on the front end supporting the table portion; a second member extending from the bench frame to support the rear end of the table in a horizontal position adjacent the bench portion; wherein the first member extends rearward from the bench to be inserted into the trailer hitch opening; and wherein the second member extends forward from the bench, and further includes an upright portion which is secured to an underside of the table portion. The pair of legs on the front end of the table and on the bench frame are height adjustable.

17 Claims, 4 Drawing Sheets

FIG. 4
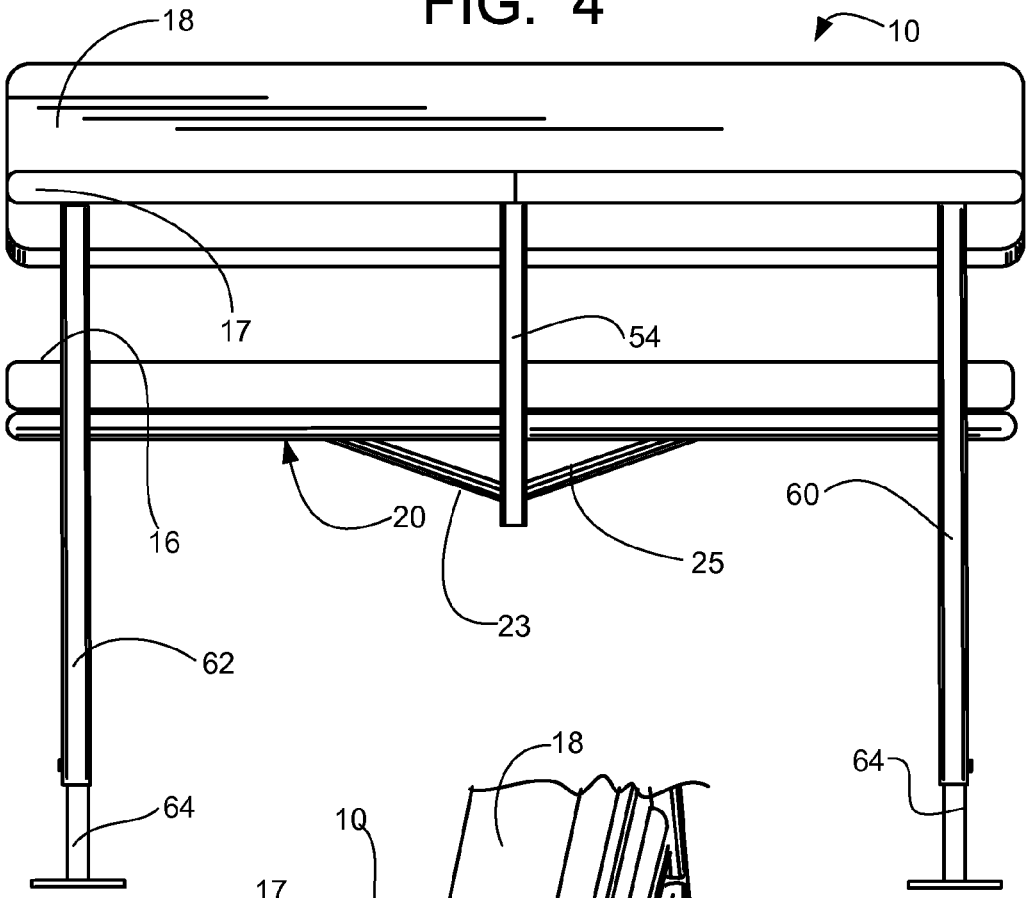
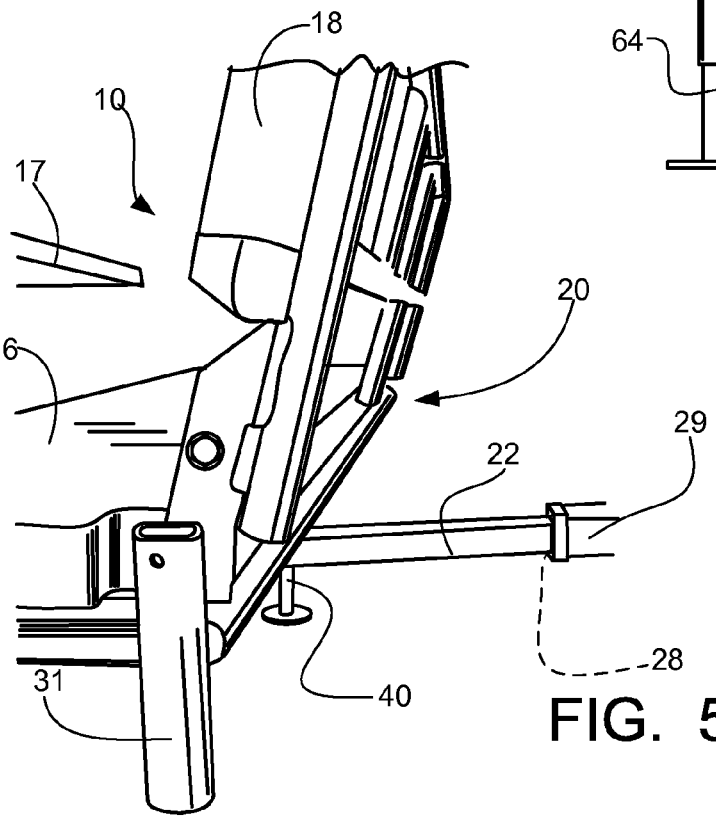
FIG. 5

TAILGATING PICNIC BENCH AND TABLE COMBINATION

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to picnic benches and tables. More particularly, the present invention relates to a picnic table and bench combination which is a unitary assembly, supported on its front end by table legs and supported on the bench end by the trailer hitch receiver.

2. General Background of the Invention

The public in general enjoys attending picnics. One particular type of picnic involves people who are attending football games, particularly in the South, where winter weather is more accommodating, prior to the game, gather in large numbers outside the stadium and hold "tailgating" parties. The name is derived from the fact that most tailgating parties take place in the stadium parking lot and most people enjoy the party, usually serving food and drinks out of their vehicle. In most cases, when the participants arrive in pickup trucks, the tailgates are lowered and the food and drink served from the truck bed, via the tailgate, hence the name "tailgating" parties.

In most cases, people want to relax at such parties, and therefore, bring their own folding tables and chairs, in order to relax, and other items to serve the hot and cold prepared food. There is always a need at such parties to accommodate as many people around the "tailgate" to enjoy the party. Therefore, it would be beneficial to be able to erect a picnic-type table and chairs or bench which could be set up near the tailgate, and have the ability to be sturdy enough to accommodate multiple people on a bench with the added convenience of having a table adjacent the bench upon which to serve and eat and drink.

The following U.S. Patents are incorporated herein by reference:

TABLE

| PAT. NO. | TITLE | ISSUE DATE |
|---|---|---|
| 5,833,308 | Rifle Mount for Vehicle and Method of Utilizing Same | Nov. 10, 1998 |
| 5,857,741 | Tailgate Table and Chairs | Jan. 12, 1999 |
| 6,125,480 | Vehicle Mounted Toilet Seat | Oct. 03, 2000 |
| 6,269,578 | Weapon Benchrest | Aug. 07, 2001 |
| 6,314,891 | Portable Picnic Table for Tailgate Parties | Nov. 13, 2001 |
| 6,739,643 | Vehicle Mounted Collapsible Chair | May 25, 2004 |
| 6,808,231 | Seat Assembly | Oct. 26, 2004 |
| 6,908,1150 | Seat for Attachment To A Vehicle Hitch or Sport Utility Rack | Jun. 21, 2005 |

TABLE-continued

| PAT. NO. | TITLE | ISSUE DATE |
|---|---|---|
| 7,073,857 | Trailer Hitch Chair Hanger | Jul. 11, 2006 |
| 7,152,358 | Multi-adjustable Portable Shooting Bench | Dec. 26, 2006 |

BRIEF SUMMARY OF THE INVENTION

The apparatus of the present invention solves the problems in the art in a simple and straightforward manner. What is provided is a combination picnic bench and table which would include a bench portion supported on a frame, having a seat portion and back portion, a metal tongue extending rearward from the frame of the bench portion, the end of which engaged in the opening of a trail hitch receiver mounted at the rear of a vehicle; a second metal member extending forward from the bench frame, terminating in an upright arm for supporting a flat table portion at one end; the second end of the table supported by a pair of adjustable legs extending from the table to the surface upon which the table will rest. There may be further included a pair of legs extended down from the ends of bench frame to assist in support the ends of the bench when multiple people are seated thereupon.

Therefore, it is a principal object of the present invention to provide a bench/table combination, wherein the bench portion is mountable to a trailer hitch of a vehicle, and the table portion is engaged to the bench frame and is supported by a pair of adjustable leg members extending between the table top and the ground or other surface.

It is a further principal object of the present invention to provide an assembly, the bench portion of which is supported by mounting to a trailer hitch of a vehicle and the table portion of which is supported by the bench frame and further supported by leg members which are removable and adjustable to allow the table portion to be supported as a flat surface for serving people at a tailgate party.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 4 is a front view of the preferred embodiment of the present invention along lines 4-4 in FIG. 2; and FIG. 5 is a partial side view of the bench frame as mounted to the trailer hitch in the preferred embodiment of the present invention.

DETAILED DESCRIPTION OF THE INVENTION

Figure 1:
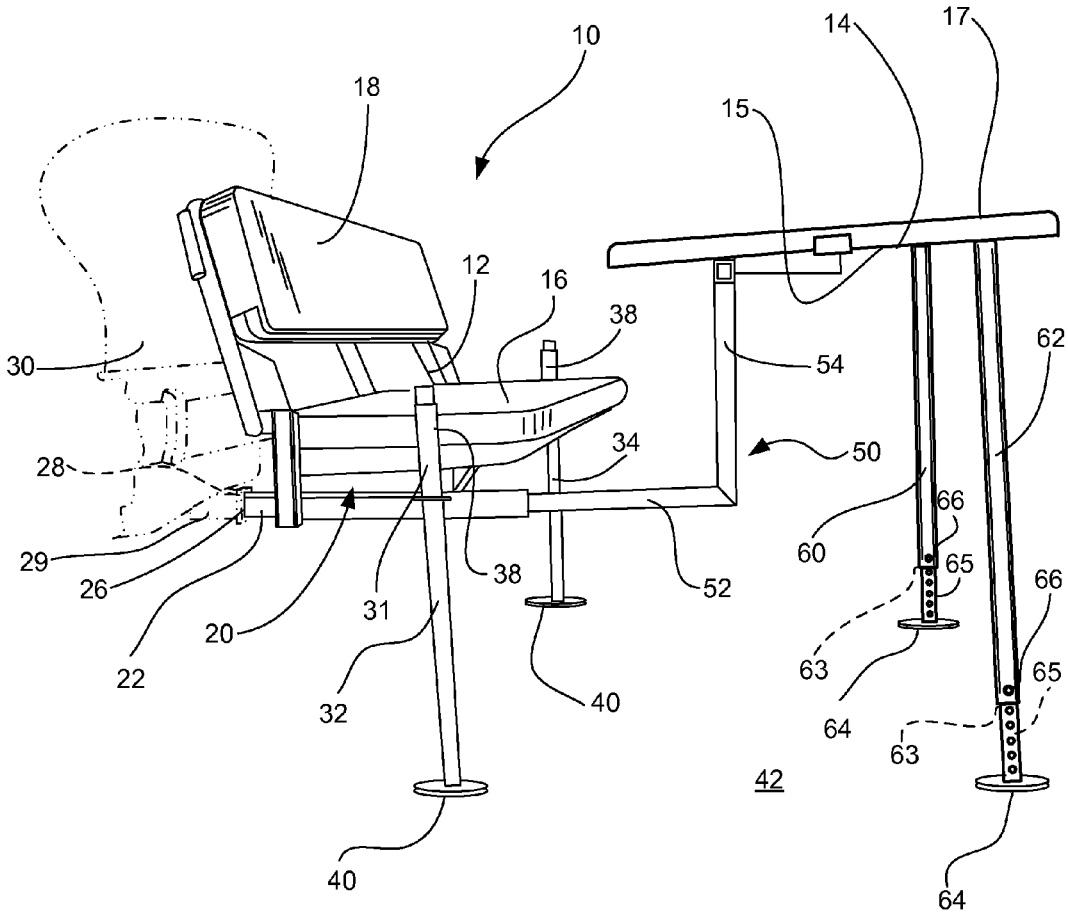
FIG. 1 is an overall perspective view of the preferred embodiment of the present invention.
Figure 2:
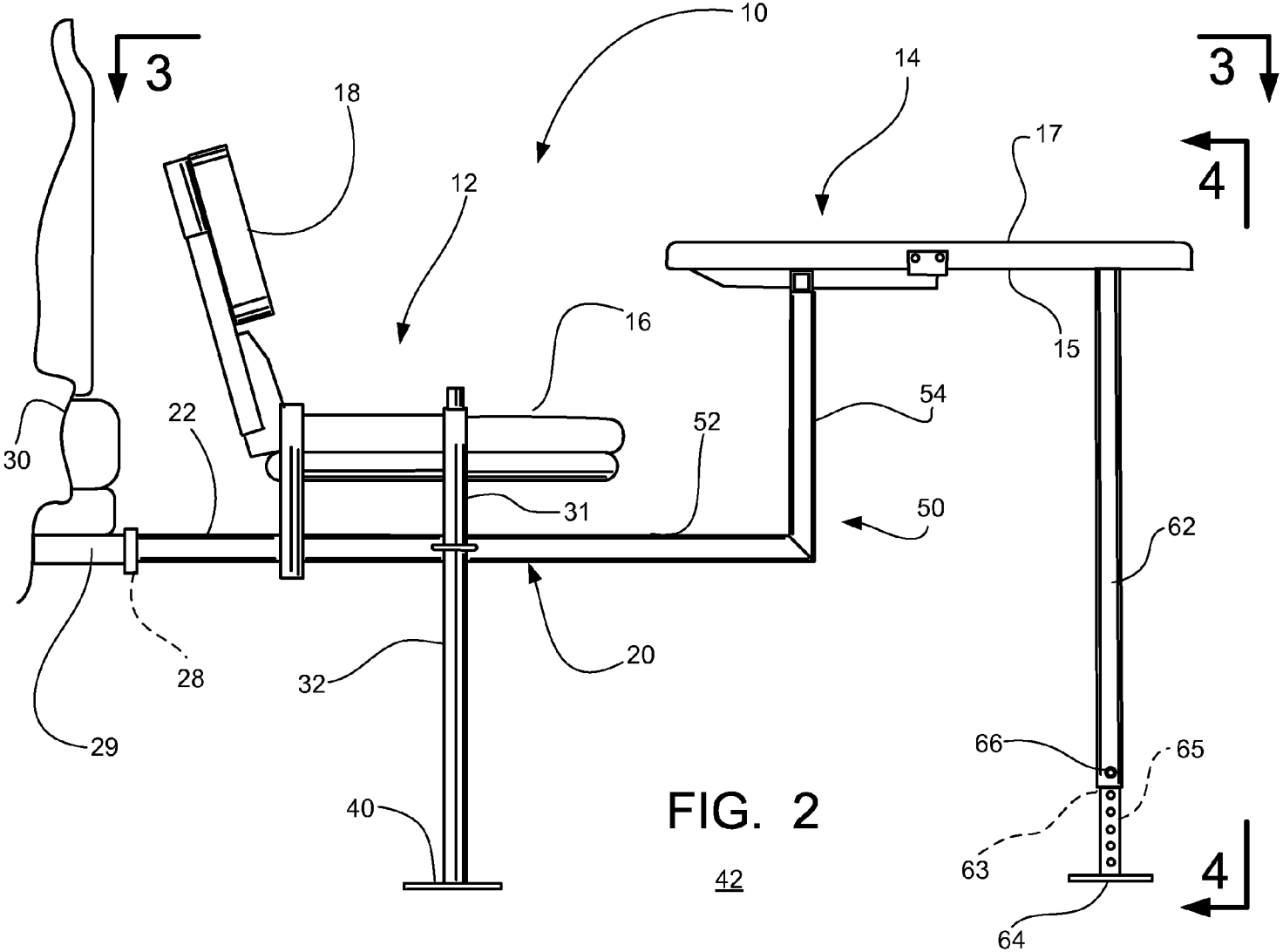
FIG. 2 is a side view of the preferred embodiment of the present invention.

FIGS. 1 through 5 illustrate the preferred embodiment of the tailgating bench and table combination of the present invention by the numeral 10. As illustrated fully in FIGS. 1 and 2, there is illustrated tailgating bench and table combination 10 which includes a bench portion 12 and a table portion 14. The bench portion 12 includes a seat portion 16 and a back portion 18. Both portions 16 and 18 mounted on a frame 20 as illustrated. As further seen, frame 20 includes an arm member 22, extending from the underside 24 of frame 20, the arm member 22 having a distal end 26 which would engage into an opening 28 of a trailer hitch 29 of a vehicle 30 as illustrated in FIGS. 1 and 2. The bench portion 12 would further include a pair of leg portions 32 and 34, each of which would extend from the two side edges 38 of seat frame portion 20, with each of the legs 32, 34 having a foot portion 40 resting on a surface such a ground 42. Each of the legs 32, 34 would help to support the bench portion 12 at the edges 38 of the bench portion 12, by each leg 32, 34 engaged within a housing 31. However, the bench portion 12 would primarily be supported by the frame arm member 22 engaged into the trailer hitch opening 28 of vehicle 30. It is foreseen that each of the leg members 32, 34 secured within housings 31 may be height adjustable so that the bench portion 12 is level with the surface 42 upon which it rests.

Furthermore, frame 20 further includes a second frame portion 50 which includes a member 52 extending forward, horizontal to the ground 42 and which would terminate in an upright member 54 which would be engaged to the underside 15 of table 14 and would serve as a first support the table portion 14 of the combination 10. Further, the table portion 14 would include a pair of leg portions 60 and 62 which would have the ability to be height adjustable, each leg 60, 62 having a foot portion 64 which would slide into an opening 63 at the end of each leg 60, 62, and include a pin 66 which would engage into a plurality of openings 65 in each foot portion 64 so that the foot portions 64 can be extended outward to the point where the table top 17 is horizontal to the ground 42 and is supported by the leg portions 60, 62 on its forward end portion 19.

Figure 3:
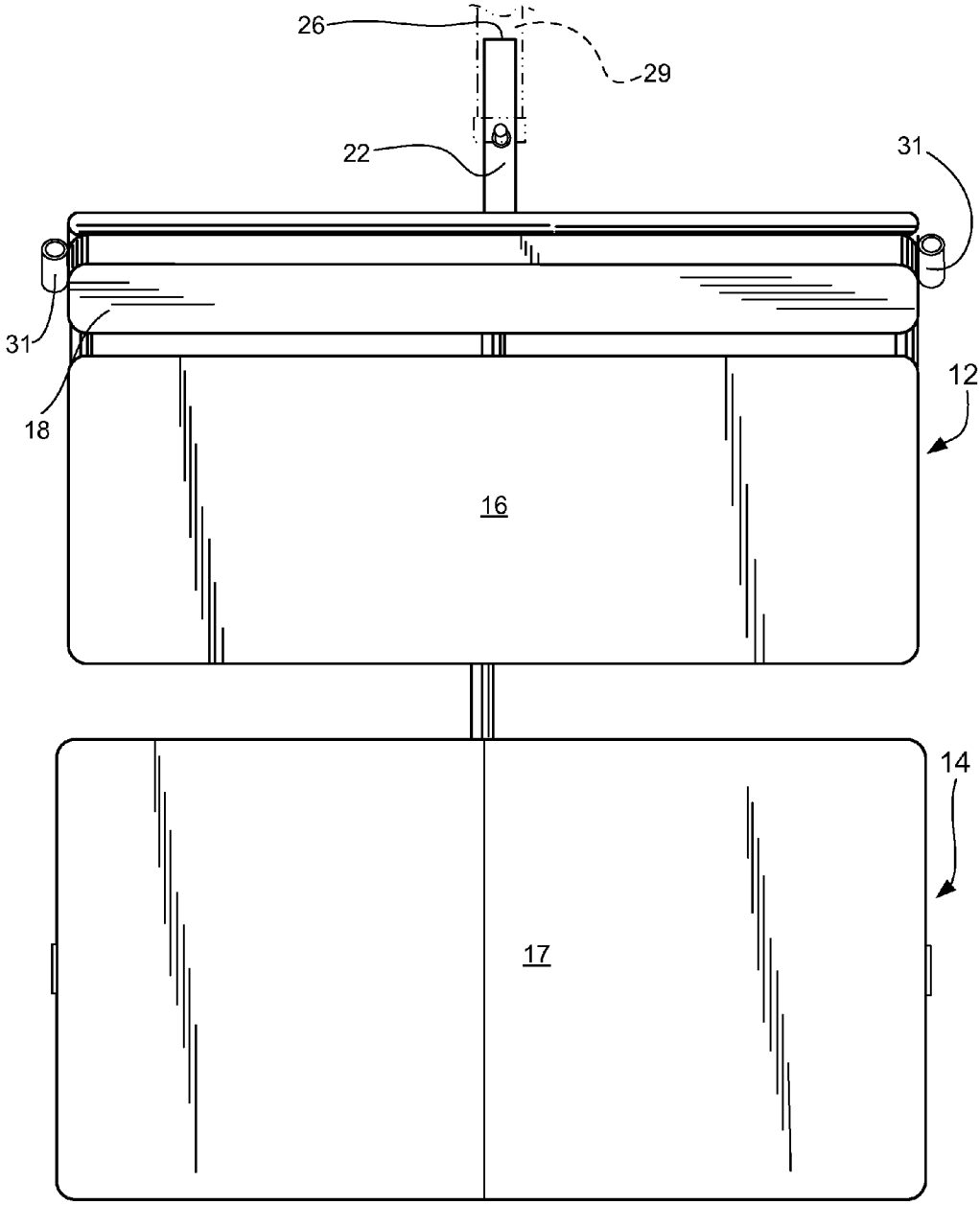
FIG. 3 is a top view of the preferred embodiment of the present invention along lines 3-3 in FIG. 2.

In FIG. 3 the bench and table combination 10 is illustrated in top view, with the bench portion 12 showing the arm member 22 extending rearward from frame 20 and engaged into the trailer hitch 29 of the vehicle 30. There is further illustrated the two circular housings 31 on each edge 38 of the frame 20, each of which would house the legs 32, 34, as seen in FIG. 1. FIG. 4 illustrates a front view of the bench and table combination 10, as it would be supported onto the vehicle 30, where there is seen additional support brackets 23, 25 on the frame 20, which further support the bench portion 12 and the member 22 engaged onto the trailer hitch 29. There is also illustrated the extendable foot portions 64 of each of the table legs 60, 62 as described fully in regard to FIGS. 1 and 2 above. Finally, FIG. 5 illustrates a partial view of the bench and table combination 10 engaged to the vehicle 30, again illustrating one of the housings 31 into which the bench legs 32, 34 would be engaged, and a side view of the member 22 slidingly engaged into the trailer hitch 29 as described earlier.

It is through the combination of the arm member 22 engaged within trailer hitch opening 28 and the pair of bench legs 32, 34, and the pair of table legs 60, 62, all part of one combination which allows the bench and table combination 10 function as a single until which is able to support several individuals attending a tailgating party.

The following is a list of parts and materials suitable for use in the present invention.

PARTS LIST

| Part Number | Description |
|---|---|
| 10 | bench and table combination |
| 12 | bench portion |

-continued

| Part Number | Description |
|---|---|
| 14 | table portion |
| 15 | underside |
| 16 | seat portion |
| 17 | table top |
| 18 | back portion |
| 20 | frame |
| 22 | arm member |
| 23, 25 | support brackets |
| 24 | underside |
| 26 | distal end |
| 28 | opening |
| 29 | trailer hitch |
| 30 | vehicle |
| 31 | circular housings |
| 32, 34 | leg portions |
| 38 | side edges |
| 40 | foot portion |
| 42 | surface |
| 50 | second frame portion |
| 52 | member |
| 54 | upright member |
| 60, 62 | leg portions |
| 63 | opening |
| 64 | foot portion |
| 65 | openings |
| 66 | pin |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A tailgating bench and table combination, comprising:

a. a bench portion for accommodating a plurality of persons, having a bench frame supporting a bench cushion, and further comprising a member insertable into a trailer hitch of a vehicle;

b. a pair of leg members on the bench frame, supporting the bench portion and extending vertically downward to a surface from at least two opposite ends of the bench portion, wherein the bench leg members are each housed within a housing and wherein each bench leg member further comprises a foot portion that is slidable into an opening on each leg and wherein each foot portion is height adjustable so that the bench portion may be level with the surface upon which it rests;

c. a flat table portion substantially the length of the bench portion, having a pair of legs on the front end supporting the table portion and extending vertically downward to a surface, and wherein each table leg further comprises a foot portion that is slidable into an opening on each leg and further comprises a means to engage the foot portion through a plurality of openings in each foot portion so that the foot portions can be extended downward to the point where the table portion is horizontal;

d. a second member extending from the bench frame to support the rear end of the table in a horizontal position adjacent the bench portion.

2. The tailgating bench and table combination in claim 1, wherein the first member extends rearward from the bench to be inserted into the trailer hitch opening.

3. The tailgating bench and table combination in claim 1, wherein the second member extends forward from the bench, and further comprises an upright portion which is secured to an underside of the table portion.

4. The tailgating bench and table combination in claim 1, wherein one foot portion of a leg member on the front end of the table may be adjusted to one height and the other foot portion of the other table leg member may be adjusted to the same height or a different height so that the table may be maintained at a horizontal level.

5. The tailgating bench and table combination in claim 1, wherein one foot portion of a bench leg member is adjustable to one height and the other foot portion of the other bench leg member is adjustable to a same or different height so that the bench portion may be level with the surface upon which it rests.

6. A tailgating bench and table combination, comprising:

a. a bench portion of sufficient length to accommodate multiple persons, the bench portion comprising a bench frame supporting a bench cushion, and further comprising an arm member extending rearward from the bench frame and insertable into a trailer hitch of a vehicle;

b. a first leg member on one end of the bench frame and a second leg member on the opposite end of the bench frame, the first and second leg members extending vertically downward to the ground and supporting the bench portion from each end of the bench portion and wherein the bench leg members are height adjustable;

c. a flat table portion approximately the length of the bench portion, having a pair of height adjustable legs on the front end for supporting the entire table portion, and wherein one table leg member may be adjusted to one height and the other table leg member may be adjusted to a same height or a different height so that the table may be maintained at a horizontal level;

d. a second member extending forward from the bench frame to support the rear end of the table in a horizontal position adjacent the bench portion.

7. The tailgating bench and table combination in claim 6, wherein the first and second leg members on the bench portion are height adjustable, and wherein one bench leg member may be adjusted to one height and the other bench leg member may be adjusted to a same height or a different height so that the bench may be level with the surface upon which it rests.

8. The tailgating bench and table combination in claim 6, wherein the leg members of the bench frame and legs on the table portion further comprise a foot portion at the end of each leg member.

9. A tailgating bench and table combination attachable to a vehicle, comprising:

a. a bench portion for allowing multiple persons to sit thereupon, comprising a bench frame supporting a bench cushion, and further comprising an arm member extending rearward from the bench frame and insertable into a trailer hitch of a vehicle;

b. a first adjustable leg member on one end of the bench frame and a second adjustable leg member on the opposite end of the bench frame for supporting the entire bench portion, both first and second adjustable leg members extending vertically downward to the ground for supporting the bench portion at each end of the bench portion;

c. a flat table portion of equal length as the bench portion, having a pair of height adjustable legs on the front end supporting the entire table portion, and wherein each of the leg members on the front end of the table portion has a foot portion and wherein said foot portions are able to be adjusted to varying heights so the table may be horizontal;

d. a second member extending forward from the bench frame to support the rear end of the table portion, at a height equal to the height of the front end of the table portion, so that the table portion resides in a horizontal position adjacent the bench portion, and wherein the table portion and bench portion are configured to allow multiple persons, when sitting on the bench portion, to have access to the table portion.

10. The tailgating bench and table combination in claim 9, wherein the bench portion, when in place supports at least one individual seated on the bench cushion.

11. The tailgating bench and table combination in claim 9, wherein the table leg members and bench leg members are able to be adjusted to varying heights so as to maintain the table and bench in a horizontal position.

12. The tailgating bench and table combination in claim 9, wherein the frame of the bench portion is constructed of a light weight metal.

13. The tailgating bench and table combination in claim 9, wherein the combination is installed onto the vehicle when the vehicle is in position for a tailgating party.

14. The tailgating bench and table combination in claim 12, wherein the light weight metal is aluminum.

15. The tailgating bench of claim 9, wherein the bench portion, when in place, supports three or fewer individuals.

16. The tailgating bench of claim 6, wherein the bench portion, when in place, supports three or fewer individuals.

17. The tailgating bench of claim 1, wherein the bench portion, when in place, supports three or fewer individuals.

* * * * *